US009047821B2

(12) United States Patent
Kim et al.

(10) Patent No.: US 9,047,821 B2
(45) Date of Patent: Jun. 2, 2015

(54) SCAN DRIVER AND DISPLAY DEVICE USING THE SAME

(75) Inventors: Do-Ik Kim, Yongin (KR); Wang-Jo Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 562 days.

(21) Appl. No.: 12/929,623

(22) Filed: Feb. 4, 2011

(65) Prior Publication Data

US 2011/0296262 A1 Dec. 1, 2011

(30) Foreign Application Priority Data

May 25, 2010 (KR) ..... 10-2010-0048735

(51) Int. Cl.
*G09G 3/30* (2006.01)
*G09G 3/32* (2006.01)

(52) U.S. Cl.
CPC ..... *G09G 3/3266* (2013.01)

(58) Field of Classification Search
USPC ..... 345/76–83; 315/169.3; 313/463, 504
See application file for complete search history.

(56) References Cited

U.S. PATENT DOCUMENTS

| | | | | |
|---|---|---|---|---|
| 2006/0244699 | A1* | 11/2006 | Yamazaki | 345/82 |
| 2008/0036497 | A1* | 2/2008 | Chung et al. | 326/83 |
| 2008/0036697 | A1* | 2/2008 | Chung | 345/55 |
| 2008/0036712 | A1* | 2/2008 | Chung | 345/82 |

FOREIGN PATENT DOCUMENTS

| | | | |
|---|---|---|---|
| KR | 10-0748358 | B1 | 8/2007 |
| KR | 10-0748359 | B1 | 8/2007 |
| KR | 10-0748360 | B1 | 8/2007 |
| KR | 10 2007-0100545 | A | 10/2007 |

* cited by examiner

*Primary Examiner* — Jimmy H Nguyen
(74) *Attorney, Agent, or Firm* — Lee & Morse, P.C.

(57) ABSTRACT

A scan driver includes a first decoder generating a plurality of output signals through a plurality of first logic gates, and a second decoder including a plurality of first logic circuits connected to a first terminal of a plurality of scan lines and a plurality of second logic circuits connected to a second terminal of the plurality of scan lines. The plurality of first logic circuits supply a source current to a corresponding scan line according to the corresponding output signal among the plurality of output signals. The plurality of second logic circuits sinks a sink current to the corresponding scan line according to the corresponding output signal among the plurality of output signals.

22 Claims, 5 Drawing Sheets

SCAN DRIVER AND DISPLAY DEVICE USING THE SAME

BACKGROUND

1. Field

Embodiments relate to a scan driver and a display device including the same. More particularly, embodiments relate to a display device applied to a high resolution display panel of a large size by providing a scan driver circuit capable of driving with a high speed without usage of a CMOS transistor structure under digital driving of the display device.

2. Description of the Related Art

Various kinds of flat display devices that are capable of reducing detriments of cathode ray tubes CRT, such as their heavy weight and large size, have been developed in recent years. Such flat display devices include liquid crystal displays (LCDs), field emission displays (FEDs), plasma display panels (PDPs), and organic light emitting diode (OLED) displays.

Among the above flat panel displays, OLED displays using an OLED generate light by a recombination of electrons and holes for the display of images. OLED displays have a fast response speed, are simultaneously driven with low power consumption, and have excellent luminous efficiency, luminance, and viewing angle. Generally, the OLED displays are classified into passive matrix OLED (PMOLED) displays and active matrix OLED (AMOLED) displays according to a driving method of the OLED.

PMOLED displays use a method in which an anode and a cathode are formed to cross each other, and cathode lines and anode lines are selectively driven. PMOLED displays have a simple structure and a low cost. However it is difficult to realize a PMOLED displays having a large size or high accuracy.

AMOLED displays use a method in which a thin film transistor and a capacitor are integrated in each pixel and a voltage is maintained by the capacitor. AMOLED displays may be used to realize a panel of a large size and/or high accuracy. However, it is difficult to technically realize the control method thereof and AMOLED displays have a comparatively high cost.

Due to demand for improved resolution, contrast, and operation speed, the current trend is toward the AMOLED displays, in which respective unit pixels selectively are turned on or off. AMOLED displays generally include pixels arranged in a matrix format, a data driver transmitting a data signal to data lines connected to the pixels, and a scan driver transmitting a scan signal to scan lines connected to the pixels.

In an analog driving method, the scan driver selects the pixels as a line unit while sequentially supplying the scan signal every horizontal period. The data driver supplies the data signal to the selected pixels by the line unit by the scan signal. Thus, the pixels supply a predetermined current corresponding to the data signal to the OLED, thereby displaying a predetermined image corresponding to the data signal.

In a digital driving method, the AMOLED display divides one frame into a plurality of sub-frames, resulting in short scan times, which scan driver to operate at high speeds. Typically, scan drivers used includes a CMOS transistor.

The above information disclosed in this Background section is only for enhancement of understanding of the background of the invention and therefore it may contain information that does not form the prior art that is already known in this country to a person of ordinary skill in the art.

SUMMARY

Embodiments are therefore directed to a scan driver and a display device using the same, which substantially overcome one or more of the problems due to the limitations and disadvantages of the related art.

It is therefore a feature of an embodiment to provide a scan driver capable of being used for a high resolution display panel of a large size.

It is therefore a feature of an embodiment to provide a scan driver that is capable of being driven at a high speed.

It is yet another feature of an embodiment to provide a scan driver capable having an improved process yield by reducing the number of transistors required for implementation.

It is still another feature of an embodiment to provide a scan driver operating at a high speed without requiring a CMOS transistor structure.

It is still another feature of an embodiment to provide a scan driver in which a pulse voltage level of the plurality of scan signals supplied to a plurality of pixels is determined by a plurality of logic circuit pairs, e.g., scan lines may be supplied with a predetermined current by one circuit of the logic circuit pair and may be sunk by another circuit of the logic circuit pair.

It is still another feature embodiment to provide a display device including a scan driver having one or more of the above features.

At least one of the above and other features and advantages may be realized by providing a scan driver including a first decoder generating a plurality of output signals through a plurality of first logic gates and a second decoder including a plurality of first logic circuits connected to a first terminal of a plurality of scan lines and a plurality of second logic circuits connected to a second terminal of the plurality of scan lines. The plurality of first logic circuits supply a source current to a corresponding scan line according to a corresponding output signal among the plurality of output signals. The plurality of second logic circuits sink a sink current to a corresponding scan line according to a corresponding output signal among the plurality of output signals.

The first decoder may include a plurality of first sub-decoders, each first sub-decoder including a subset of the plurality of first logic gates that generate a subset of the plurality of output signals.

The second decoder may include a second sub-decoder including the plurality of first logic circuits and a second sub-decoder including the plurality of second logic circuits.

Each first logic circuit may respectively include a plurality of first transistors switched in response to one of the plurality of output signals and a plurality of inversion output signals, and supplies the source current corresponding to a high power source voltage to the corresponding scan line according to switching states of the plurality of first transistors.

Each second logic circuit may respectively include a plurality of second transistors switched in response to another one of the plurality of output signals and the plurality of inversion output signals, and sinks the sink current corresponding to the low power source voltage to the corresponding scan line according to switching states of the plurality of second transistors.

The pulse voltage of the scan signal transmitted to the corresponding scan line may be high when the first logic circuit operates, and the pulse voltage of the scan signal transmitted to the corresponding scan line may be low when the second logic circuit operates.

The plurality of first and second transistors are all PMOS transistors or all NMOS transistors. The plurality of first and second transistors are PMOS transistors when a pixel circuit element supplied with the scan signal includes a PMOS transistor and are NMOS transistors when the pixel circuit element includes an NMOS transistor.

When the plurality of first and second transistors are PMOS transistors, the plurality of first transistors are coupled in parallel between the high power source voltage and the corresponding scan line, and gate electrodes thereof receive a plurality of input signals, and the plurality of second transistors are coupled in series between the corresponding scan line and the low power source voltage, and gate electrodes thereof receive a plurality of inverted signals of the plurality of input signals.

The plurality of input signals may be the plurality of inversion output signals for the plurality of output signals of the first decoders.

A second logic gate realized by the first logic circuit and the second logic circuit may be an OR gate.

When the plurality of first and second transistors are NMOS transistors, the plurality of first transistors are coupled in series between the high power source voltage and the corresponding scan line, and gate electrodes thereof receive a plurality of input signals, and the plurality of second transistors are coupled in parallel between the corresponding scan line and the low power source voltage, and the gate electrodes thereof receive a plurality of inverted signals of the plurality of input signals.

The plurality of input signals may be the plurality of output signals of the first decoder.

A second logic gate realized by the first logic circuit and the second logic circuit may be an AND gate.

A number of first logic gates of the first decoder may be determined according to a number of scan lines.

A second logic gate realized by the first logic circuit and the second logic circuit may be an OR gate when a pixel circuit element connected to the plurality of scan lines includes a PMOS transistor, and may be an AND gate when the pixel circuit element includes an NMOS transistor.

At least one of the above and other features and advantages may be realized by providing a display device including a scan driver transmitting a plurality of scan signals to a plurality of scan lines, a data driver transmitting a plurality of data signals to the plurality of data lines, and a plurality of pixels respectively connected to the corresponding scan line among the plurality of scan lines and the corresponding data line among the plurality of data lines, and including an organic light emitting diode (OLED) emitting light through a driving current according to the data signal by being selected when the scan signal is transmitted, and receiving the data signal. The scan driver includes a first decoder generating a plurality of output signals through a plurality of first logic gates, and a second decoder including a plurality of first logic circuits connected to a first terminal of a plurality of scan lines and a plurality of second logic circuits connected to a second terminal of the plurality of scan lines. The plurality of first logic circuits supply a source current to a corresponding scan line according to the corresponding output signal among the plurality of output signals. The plurality of second logic circuits sinks a sink current to the corresponding scan line according to the corresponding output signal among the plurality of output signals.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
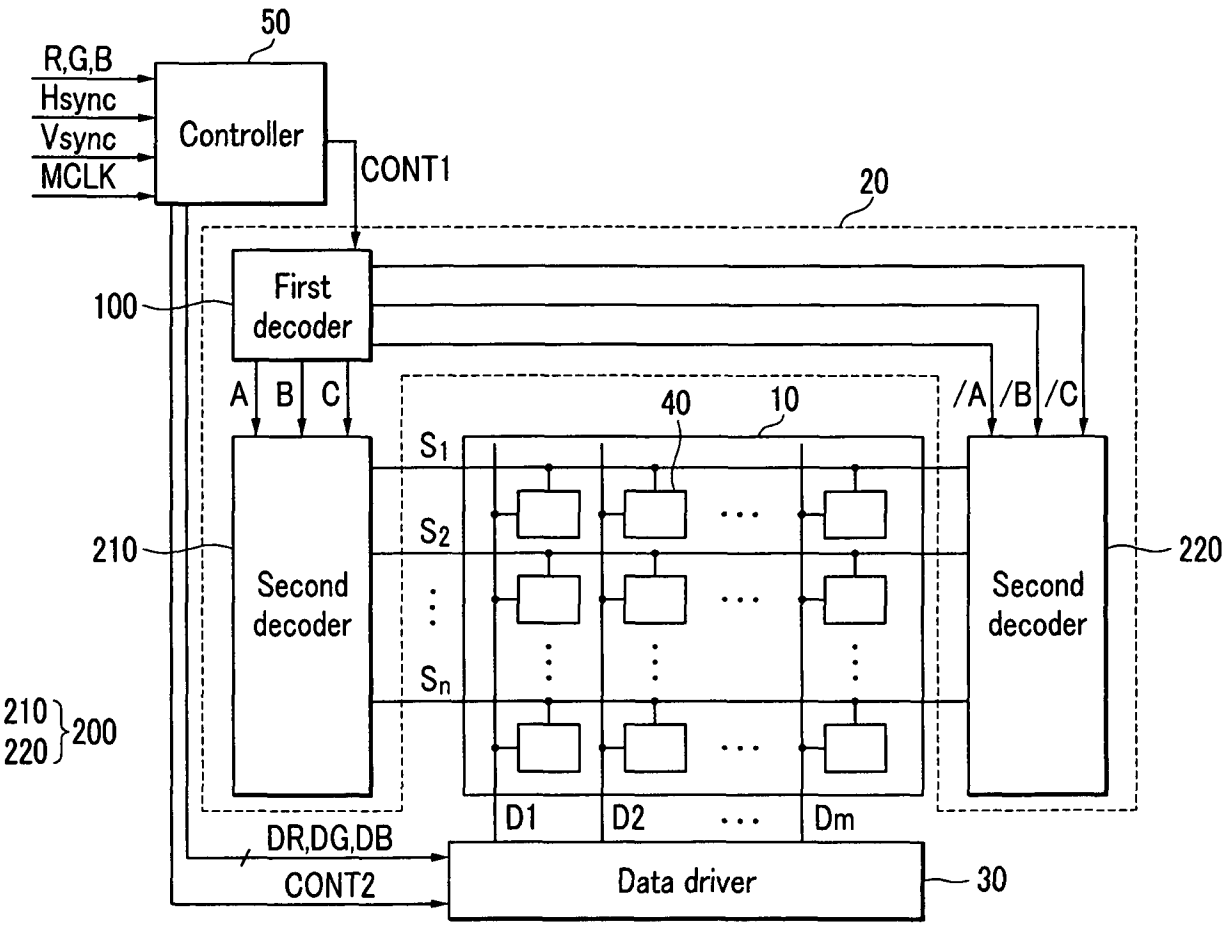
FIG. 1 illustrates a block diagram of a display device according to an exemplary embodiment of the present invention.

Korean Patent Application No. 10-2010-0048735, filed on May 25, 2010, in the Korean Intellectual Property Office, and entitled: "Scan Driver and Display Device Using the Same," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

Constituent elements having the same structures throughout the embodiments are denoted by the same reference numerals and are described in a first embodiment. In the other embodiments, only constituent elements other than the same constituent elements will be described.

In addition, parts not related to the description are omitted for clear description of the present invention, and like reference numerals designate like elements and similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 illustrates a block diagram of a display device according to an exemplary embodiment. Referring to FIG. 1, a display device according to an exemplary embodiment includes a display unit 10, a scan driver 20, data driver 30, and a controller 50.

The display unit 10 includes a plurality of pixels 40. Each pixel 40 includes an organic light emitting diode (not shown) emitting light corresponding to a flow of a driving current according to a data signal transmitted from the data driver 30. The pixels 40 are connected to a plurality of scan lines S1 to Sn formed in a row direction and transmitting scan signals, and a plurality of data lines D1 to Dm formed in a column direction and transmitting data signals.

A first power source voltage ELVDD and a second power source voltage ELVSS used to operate the display unit 10 are transmitted from a power supply unit (not shown).

The scan driver 20 that applies scan signals to the display unit 10 is connected to the plurality of scan lines S1 to Sn and transmits the plurality of scan signals to a corresponding scan line of the plurality of scan lines. The scan driver 20 includes a first decoder 100 and two second sub-decoders 210 and 220. The second sub-decoders 210 and 220 form a second decoder 200.

The first decoder 100 receives a scan driving control signal CONT1 from the controller 50, and generates and transmits a plurality of input signals to the two second sub-decoders 210 and 220. The second sub-decoders 210 and 220 receive the plurality of input signals, and generate and transmit the scan signals to the corresponding scan line among the plurality of scan lines S1 to Sn.

The first decoder 100 in an exemplary embodiment is included in the scan driver 20. However, embodiments are not limited thereto. For example, the first decoder 100 may be variously formed to be included in the controller 50 or the data driver 30.

In detail, the plurality of input signals generated and transmitted from the first decoder 100 include a plurality of input signals A, B, and C, and inversion input signals /A, /B, and /C (hereinafter, referred to as input-bar signals). While three input signals and three input-bar signals are illustrated in the exemplary embodiment of FIG. 1, the number of input signals is not limited thereto, and the number may be determined for the various input signals to be transmitted according to the circuit structure.

Referring to FIG. 1, the second sub-decoder 210 receives the plurality of input signals A,B, and C, and the second sub-decoder 220 receives the plurality of input-bar signals /A,/B, and /C. Here, the two second sub-decoders 210 and 220 are disposed to be symmetrical to each other and are positioned on opposite sides of the plurality of scan lines S1 to Sn, and one of the second sub-decoders 210 and 220 generates the scan signals and transmits them to the plurality of scan lines S1 to Sn.

The two second sub-decoders 210 and 220 form a plurality of logic gate circuits outputting the scan signals corresponding to the plurality of pixels 40 included in the display unit 10. When a plurality of transistors forming the circuits of the plurality of pixels 40 included in the display unit 10 are PMOS transistors, the second sub-decoders 210 and 220 may operate as an OR gate outputting a pulse of a low level. In contrast, when a plurality of transistors forming the circuits of the plurality of pixels 40 included in the display unit 10 are NMOS transistors, the second sub-decoders 210 and 220 may operate as an AND gate outputting a pulse of a high level. The function of the two second sub-decoders 210 and 220 and the generating and transmitting process of the scan signals will be described with reference to FIG. 3 to FIG. 5 in detail below.

The data driver 30 transmits the data signals to the display unit 10 by generating a plurality of data signals and transmitting them to the plurality of data lines D1 to Dm in accordance with a data driving control signal CONT2 and image data signals DR, DG, and DB transmitted from the controller 50.

If the plurality of data signals are transmitted to the plurality of data lines D1 to Dm in synchronization with the time that the plurality of scan signals are transmitted to the corresponding scan line, the driving current according to the data signal flows in the organic light emitting diode (OLED) (not shown) of the pixels 40, thereby emitting light.

The controller 50 is connected to the scan driver 20 and the data driver 30, and receives image signals R, G, and B, synchronization signals Hsync and Vsync, and a clock signal MCLK. The controller 50 generates and transmits the scan driving control signal CONT 1 and data driving control signal CONT2 to the scan driver 20 and the data driver 30, respectively.

The controller 50 receives RGB image signals including grayscale data of red (R), blue (B), and green (G) to generate image data signals DR, DG, and DB, and transmits the image data signals DR, DG, and DB to the data driver 30.

Figure 2:
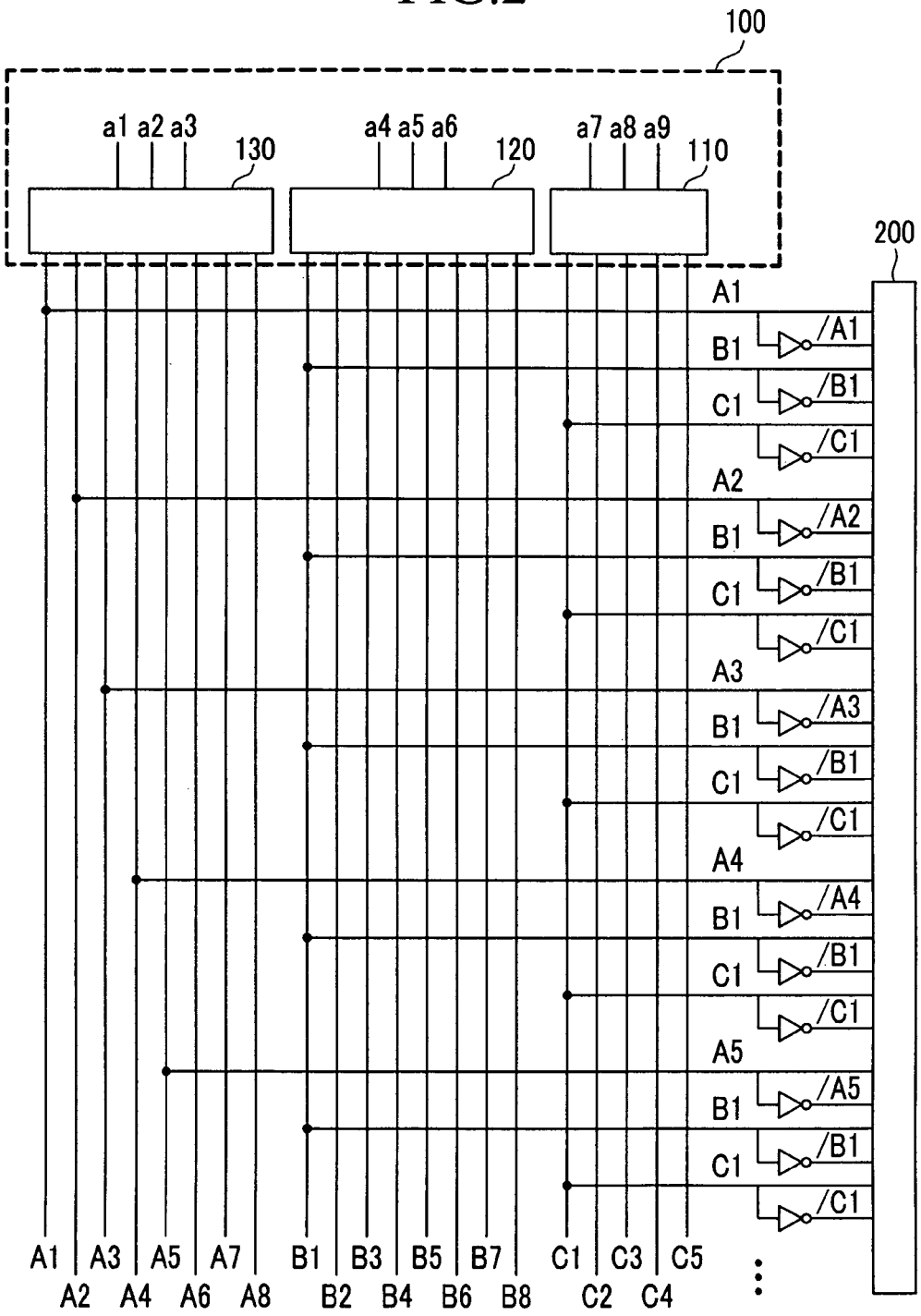
FIG. 2 illustrates a view of a structure of a scan driver according to an exemplary embodiment of the present invention.

The scan driver 20 according to an exemplary embodiment is a scan driver included in the digitally driven display device in which one frame is divided into a plurality of sub-frames and driven, and the structure thereof is shown in FIG. 2.

FIG. 2 illustrates a view of a structure of the scan driver 20 according to an exemplary embodiment. For better understanding and ease of description, FIG. 2 shows only components corresponding to first to fifth scan lines S1, S2, S3, S4, and S5 among the plurality of scan lines S1 to Sn.

The scan driver 20 according to an exemplary embodiment shown in FIG. 2 includes the first decoder 100 including a plurality of first sub-decoders 110, 120, and 130, and the second decoder 200 receiving the plurality of output signals from the plurality of first sub-decoders 110, 120, and 130 for a logical operation. The second decoder 200 includes the two second sub-decoders 210 and 220, as described in FIG. 1.

The plurality of first sub-decoders 110, 120, and 130 may include a plurality of first logic gates. The second decoder 200 may include a plurality of second logic gates that form the two second sub-decoders 210 and 220, illustrated in FIG. 3. The first logic gates and the second logic gates may operate as OR gates or AND gates. However, the logic gates are not limited thereto.

In the exemplary embodiment of FIG. 2, the plurality of first sub-decoders 110, 120, and 130 forming the first decoder 100 receive three input signals and transmit 8 or 5 output signals. That is, the first sub-decoders 130 and 120 may be a 3 by 8 decoder and the first sub-decoder 110 may be a 3 by 5 decoder. However, in the plurality of first sub-decoders, the number of input terminals receiving input signals and the number of output terminals transmitting output signals are not limited by the exemplary embodiment of the FIG. 2, and may be variously set.

The first sub-decoder 130 of the plurality of first sub-decoders 110, 120, and 130 shown in FIG. 2 receives three input signals a1, a2, and a3, and outputs eight output signals A1 to A8. The first sub-decoder 120 receives three input signals a4, a5, and a6, and outputs eight output signals B1 to B8. Finally, the first sub-decoder 110 receives three input signals a7, a8, and a9, and outputs five output signals C1 to C5.

The plurality of first sub-decoders included in the first decoder 100 may include the logic gates of the same number as the output terminals transmitting the output signals. In the exemplary embodiment of FIG. 2, the first sub-decoders 130 and 120 may include eight OR gates, and the first sub-decoder 110 may include five OR gates.

The number of logic gates included in the first sub-decoders 110, 120, and 130 may be determined by the number of scan lines connected to the scan driver 20. For example, the number of OR gates included in the plurality of first sub-decoders 110, 120, 130, i.e., five, eight, and eight in FIG. 2, make a total of 21. This number of OR gates is determined in order to supply scan signals to the 320 scan lines (5×8×8=320).

The second decoder 200 sequentially receives the corresponding output signals one by one among the plurality of output signals output from the plurality of first sub-decoders 110, 120, and 130 as input signals. In detail, to generate a scan signal supplied to one scan line, the second decoder 200 selectively receives the output signals output from the plurality of first sub-decoders 110, 120, and 130 one by one, and also receives the inversion signal (input-bar signal "/") of the output signal as the input signals. In the exemplary embodiment of FIG. 2, the second decoder 200 receives one output signal and the inversion signal therefor output from the plurality of first sub-decoders 110, 120, and 130 as the input signals, thereby receiving six input signals (three input signals and three input-bar signals).

For example, to generate the scan signal supplied to the first scan line, the second decoder 200 selects and receives A1 among eight output signals of the first sub-decoder 130, B1 among eight output signals output from the first sub-decoder 120, and C1 among five output signals output in the first sub-decoder 110. Furthermore, the second decoder 200 receives the inversion signals /A1, /B1, and /C1 for A1, B1, and C1 as the input-bar signals. The second decoder 200 sequentially receives a plurality of output signals from the first sub-decoders 110, 120, and 130 through this method.

The two second sub-decoders 210, 220 forming the second decoder 200 are not shown in detail in the exemplary embodiment of FIG. 2, however the second decoder 200 includes one second sub-decoder receiving the output signals output from the first sub-decoders 110, 120, and 130 as the input signal as is, and another second sub-decoder receiving the inversion signals of the output signals as the input-bar signals. The plurality of input-bar signals may be generated by receiving the output signals output from the first sub-decoders 110, 120, and 130, and outputting them from an inverter.

The second decoder 200 may be realized as a plurality of second logic gates. In detail, the second sub-decoder receiving the plurality of input signals and the second sub-decoder receiving the plurality of input-bar signals may operate as the plurality of second logic gates. The plurality of second logic gates may be OR gates or AND gates according to the kind of transistors in the pixels 40. The plurality of second logic gates forming the second decoder 200 logically operate on the input signal or input-bar signal to generate a plurality of scan signals.

Figure 3:
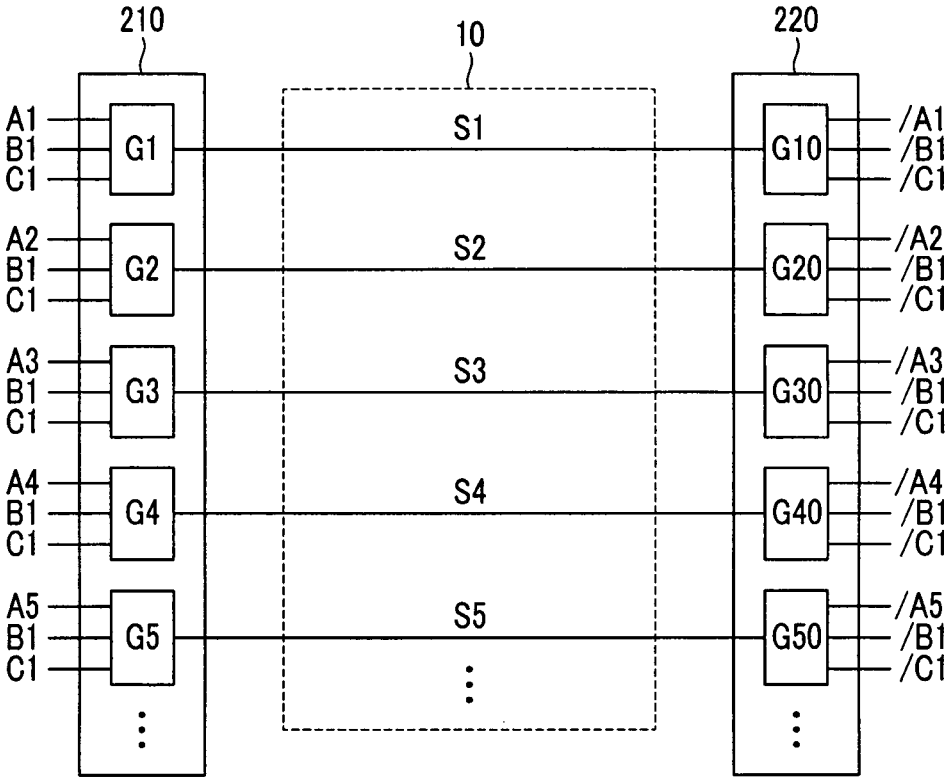
FIG. 3 illustrates a view of a structure according to an input signal transmitted to a second decoder of the scan driver shown in FIG. 2.

FIG. 3 illustrates a detailed structure of the second decoder 200 including two second sub-decoders. For better understanding and ease of description, FIG. 3 shows the first scan line S1 to the fifth scan line S5 among the plurality of scan lines connected to the scan driver 20.

According to the exemplary embodiment of FIG. 3, the second decoder 200 includes the two second sub-decoders 210 and 220. In detail, the second sub-decoder 210 receives the output signal output from the plurality of first sub-decoders of the first decoder 100 as the input signal. The second sub-decoder 220 receives the inversion signal for the output signal as the input-bar signal. However, this configuration is only exemplary, and the input sequence and the configuration of the input signal and the input-bar signal may be changed.

In FIG. 3, the second sub-decoder 210 and the second sub-decoder 220 are symmetrically connected to both ends of the plurality of scan lines. The second sub-decoder 210 and the second sub-decoder 220 share one scan line, thereby realizing one second logic gate.

In further detail, the second sub-decoder 210 includes a plurality of logic circuits G1, G2 . . . , each receiving three input signals, and the second sub-decoder 220 includes a plurality of logic circuits G10, G20 . . . , each receiving three input-bar signals. When the plurality of pixels 40 included in the display unit 10 is n, the number of scan lines is n, such that the number of logic circuits of the second sub-decoder 210 and the second sub-decoder 220 connected to the n scan lines is n.

In the exemplary embodiment of FIG. 3, the first scan signal is generated by the first logic circuit G1 and the logic circuit G10 in the second sub-decoders 210 and 220 and is supplied to the first scan line S1. The input signals of the first logic circuit G1 in the second sub-decoder 210 are A1, B1, and C1, and the input signals of the first logic circuit G10 included in the second sub-decoder 220 are /A1, /B1, and /C1, i.e., the input-bar signals of A1, B1, and C1. Accordingly, the scan signal transmitted to the first scan line S1 is determined as the output signal corresponding to the input signal and the input-bar signal according to the circuit structure of the logic circuits G1 and G10.

By this method, the second decoder 200 including a plurality of second logic gates is sequentially formed until the n-th second logic gate generating and transmitting the scan signal to the scan line Sn connected to the final pixel row (the n-th pixel row). Each second logic gate includes two logic circuits, and the current is sunk and supplied according to the supplied input signal and input-bar signal to control the voltage pulse of the output scan signal.

The scan driver 20 of the exemplary embodiment of FIG. 3 is divided into the first decoder 100 and two second sub-decoders 210 and 220 to generate the scan signals. Such a configuration is advantageous when using the random driving method compared with the sequence driving method in the analog driving of the display device. Particularly, to randomly generate the scan signal in the digital driving method, the sequence driving method using a clock of a predetermined cycle is limited. However, the scan driver 20 according to an exemplary embodiment of generates the scan signal by using two or more decoders, overcoming such limitations.

When realizing the OR gate or the AND gate of the decoder of the scan driver by using the CMOS thin film transistor circuit, such gates are made of a push-pull structure of the NMOS transistor and the PMOS transistor such that high speed operation is possible. However, the number of masks needed for the producing the CMOS transistor increases, increasing production cost. To solve this problem, if the logic gate includes all NMOS or all PMOS transistors to reduce the number of masks, driving is possible for a small display panel having a low resolution. However, previous solutions did not provide the high speed operation needed for a large and high resolution display panel.

In the scan driver 20 according to an exemplary embodiment, the logic gate includes all NMOS or all PMOS transistors, such that the number of masks may be reduced, and simultaneously, two logic circuits form one logic gate such that the logic gate operates as a push-pull structure, i.e., supplying and sinking the current, such that the high speed operation is possible. Also, the logic circuit consists of the amplification circuit of one step, such that the propagation delay time is small.

The kind of second logic gate according to an exemplary embodiment may be determined according to the kind of transistor included in the pixel 40. If the transistor included in the plurality of pixels 40 forming the display unit 10 is a PMOS transistor, the second logic gate may be realized as an OR gate generating and transmitting the scan signal having the low pulse of the predetermined low voltage level to turn on the PMOS transistor of the pixel 40. On the other hand, if the transistor included in the plurality of pixels 40 is an NMOS transistor, the second logic gate may be realized as the AND gate generating and transmitting the scan signal having the high pulse of the predetermined high voltage level to turn on the NMOS transistor in the pixel 40.

Figure 4:
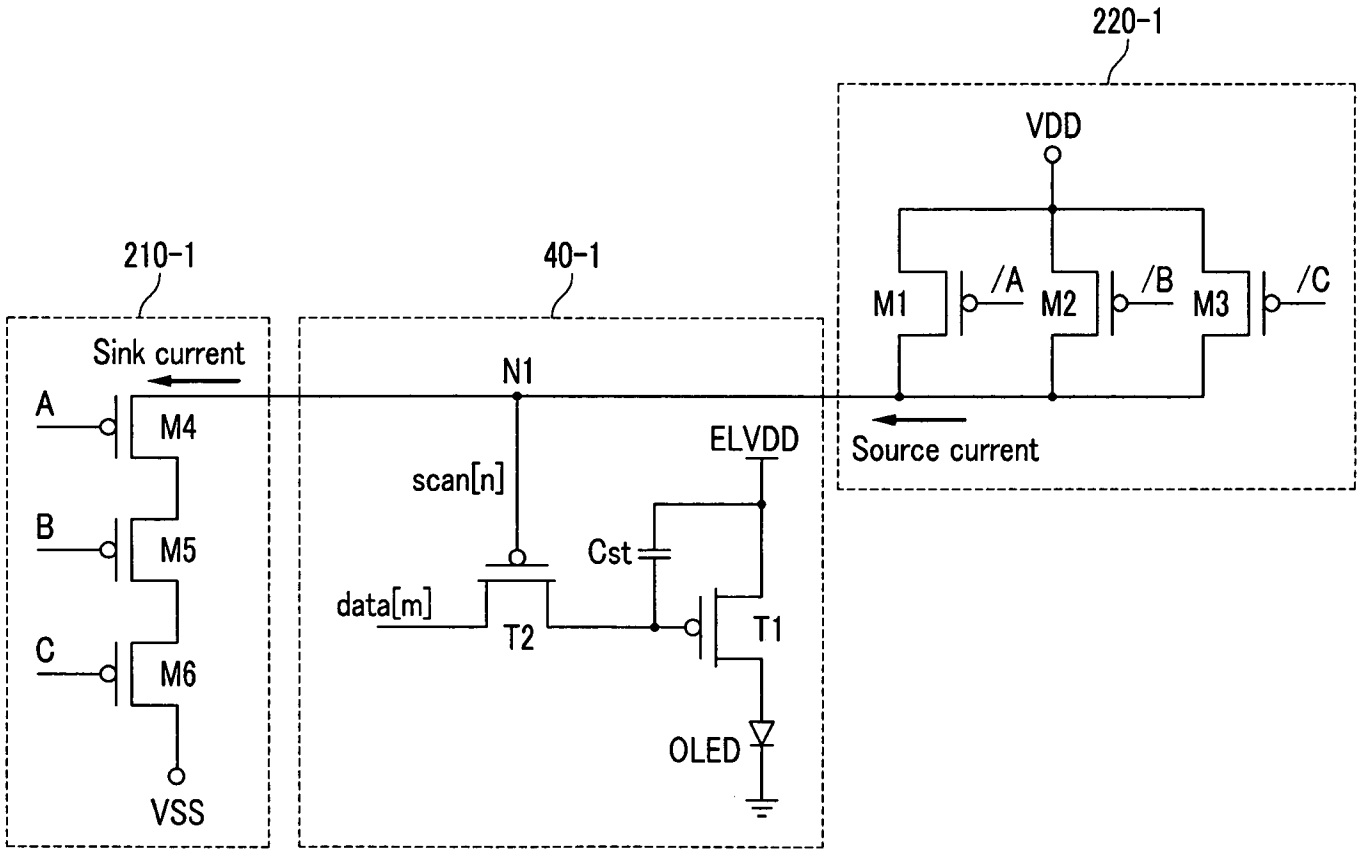
FIG. 4 illustrates a circuit diagram of a second decoder of a scan driver realized using PMOS transistors according to an exemplary embodiment.
Figure 5:
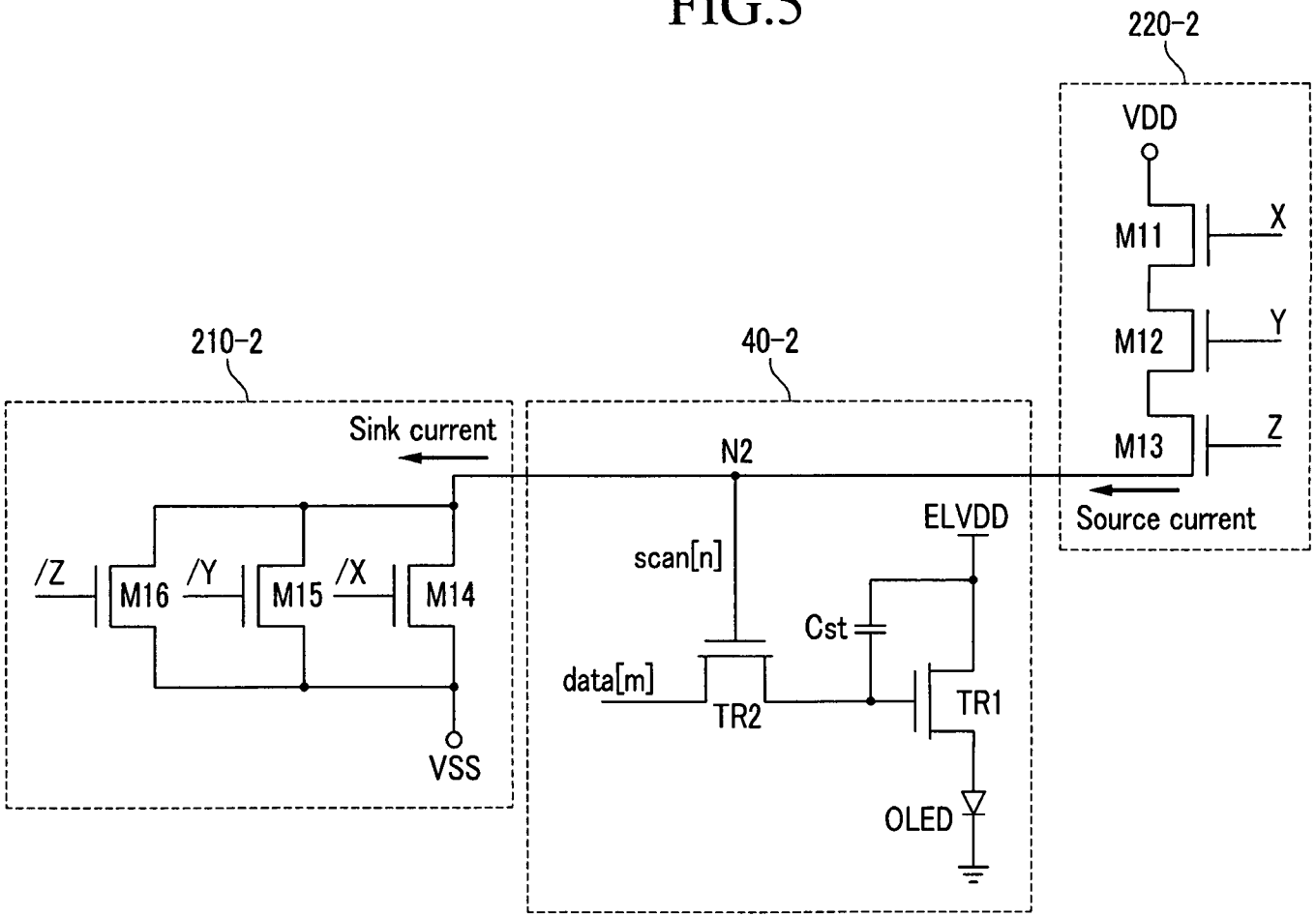
FIG. 5 illustrates a circuit diagram of a second decoder of a scan driver realized using NMOS transistors according to an exemplary embodiment.

The generation and transmission process of the scan signal through the configuration of the plurality of logic circuits included in the second sub-decoders 210 and 220 will be described in detail with reference to the circuit diagrams of FIG. 4 and FIG. 5 in accordance with embodiments. FIG. 4 illustrates a circuit diagram of the second logic gate configured as an OR gate using PMOS transistors. FIG. 5 illustrates a circuit diagram of the second logic gate configured as an AND gate using NMOS transistors.

The pixel 40-1, 40-2 shown in FIG. 4 and FIG. 5 is a representative pixel corresponding to the n-th pixel row and the m-th pixel column among the plurality of pixels 40 of the display unit 10. As illustrated in FIG. 4 and FIG. 5, the logic circuit of the second sub-decoder 210-1, 210-2, and the logic circuit of the second sub-decoder 220-1, 220-2 are connected to both ends of the scan line Sn connected to n-th pixel row.

Referring to FIG. 4, the pixel 40-1 includes a driving transistor T1, a switching transistor T2, a storage capacitor Cst, and an organic light emitting diode (OLED). The circuit diagram of the pixel 40-1, 40-2 in FIGS. 4 and 5 is the same, except the transistors in the pixel 40-1 of FIG. 4 are PMOS transistors, while transistors in the pixel 40-2 of FIG. 5 are NMOS transistors. Accordingly, the circuit structure will be described focusing on the pixel 40 of FIG. 4.

The driving transistor T1 has a gate electrode connected to a drain electrode of the switching transistor T2, a source electrode connected to the first power source voltage ELVDD, and a drain electrode connected to the anode of the organic light emitting diode (OLED). The switching transistor T2 has a gate electrode connected to a first node N1 of the scan line Sn connected to the n-th pixel row, a source electrode connected to the corresponding data line Dm among the plurality of data lines, and the drain electrode connected to the node connected to one terminal of the storage capacitor Cst and the gate electrode of the driving transistor T1.

The storage capacitor Cst includes one terminal connected to the gate electrode of the driving transistor T1 and the other terminal connected to the first power source voltage ELVDD. Accordingly, the voltage difference Vgs between the gate electrode and the source electrode of the driving transistor T1 is maintained during the time that the data voltage according to the data signal data[m] is applied to the gate electrode of the driving transistor T1. The voltage difference Vgs between the gate electrode and the source electrode of the driving transistor T1 is the voltage difference between the data signal data [m] and the first power source voltage ELVDD, and the driving current flows to the driving transistor T1 according to the corresponding voltage difference.

The organic light emitting diode (OLED) includes the anode connected to the drain electrode of the driving transistor T1 and a cathode that is grounded or is connected to the driving power source voltage that is less than the first power source voltage ELVDD. If the driving transistor T1 is turned on such that the current path from the first power source voltage ELVDD is formed, the organic light emitting diode (OLED) emits light due to the driving current according to the voltage difference Vgs between the gate electrode and the source electrode of the driving transistor T1.

The data signal data[m] is supplied to the driving transistor T1 according to the switching operation of the switching transistor T2, and the switching operation of the switching transistor T2 is controlled by the scan signal scan[n] transmitted to the n-th scan line Sn.

In the exemplary embodiment of FIG. 4, the switching transistor T2 of the pixel 40-1 is a PMOS transistor. Thus, a scan signal scan[n] transmitted as a pulse having the low voltage level to the gate electrode of the switching transistor T2 turns on the switching transistor T2 for the operation of the pixel 40.

Accordingly, the transistors in the logic circuit of the second sub-decoder 210-1 are turned on and the transistors in the logic circuit of the second sub-decoder 220-1 are turned off, such that the scan signal scan[n] is applied as the pulse of the low level. In the rest condition, the scan signal scan[n] is applied as the pulse of the high level, such that the second logic gate realized by the logic circuit of the second sub-decoder 210-1 and the logic circuit of the second sub-decoder 220-1 is an OR gate. Transistors forming the logic circuit of the second sub-decoder 210-1 and the logic circuit of the second sub-decoder 220-1 are PMOS transistors.

The logic circuit of the second sub-decoder 220-1 includes a first transistor M1, a second transistor M2, and a third transistor M3 coupled in parallel between the first power source voltage VDD and the first node N1. The first transistor M1, the second transistor M2, and the third transistor M3 each include a gate electrode receiving an input signal, a source electrode receiving the first power source voltage VDD, and a drain electrode connected to the first node N1.

Three input signals respectively input to the gate electrode of the first transistor M1, the second transistor M2, and the third transistor M3 are the input-bar signals as the inversion signals of the signals output from the first decoder 100, as described in FIG. 2. That is, the input signals are the first input-bar signal /A, the second input-bar signal /B, and the third input-bar signal /C, i.e., the first input signal A, the second input signal B, and the third input signal C output from the first decoder 100 that have been inverted.

The logic circuit of the second sub-decoder 210-1 includes a fourth transistor M4, a fifth transistor M5, and a sixth transistor M6 coupled in series between the first node N1 and the second power source voltage VSS. The fourth transistor M4, the fifth transistor M5, and the sixth transistor M6 each have a gate electrode receiving an input signal.

The fourth transistor M4, the fifth transistor M5, and the sixth transistor M6 are sequentially coupled in series. A source electrode of the fourth transistor M4 is connected to the first node N1 and a drain electrode of the fourth transistor M4 is connected to a source electrode of the fifth transistor M5. A drain electrode of the fifth transistor M5 is connected to a source electrode of the sixth transistor M6, and a drain electrode of the sixth transistor M6 is connected to the second power source voltage VSS.

The first power source voltage VDD is the predetermined high level voltage, and the second power source voltage VSS is the predetermined low level voltage.

Three input signals respectively input to the gate electrodes of the fourth transistor M4, the fifth transistor M5, and the sixth transistor M6 are the first input signal A, the second input signal B, and the third input signal C output from the first decoder 100.

The operation process of the logic circuit of the second sub-decoders 210 and 220 will be described with reference to a truth table of the OR gate, provided below as Table 1.

TABLE 1

| First input signal A | Second input signal B | Third input signal C | scan[n] |
|---|---|---|---|
| 0 | 0 | 0 | 0 |
| 0 | 0 | 1 | 1 |
| 0 | 1 | 0 | 1 |

TABLE 1-continued

| First input signal A | Second input signal B | Third input signal C | scan[n] |
|---|---|---|---|
| 0 | 1 | 1 | 1 |
| 1 | 0 | 0 | 1 |
| 1 | 0 | 1 | 1 |
| 1 | 1 | 0 | 1 |
| 1 | 1 | 1 | 1 |

When at least one of the first input signal A, the second input signal B, and the third input signal C is high, at least one of the inverted signals input to the gate electrodes of the first transistor M1, the second transistor M2, and the third transistor M3 is low. Accordingly, at least one transistor of the first transistor M1, the second transistor M2, and the third transistor M3 may be turned on. Thus, the first power source voltage VDD is transmitted as the high level voltage to the first node N1 through the turned-on transistor(s) among the first transistor M1, the second transistor M2, and the third transistor M3. That is, the current according to the first power source voltage VDD is supplied to the first node N1 as the scan signal scan[n] of the high level.

Simultaneously, the first input signal A, the second input signal B, and the third input signal C are transmitted to the gate electrodes of the fourth transistor M4, the fifth transistor M5, and the sixth transistor M6 included in the logic circuit of the second sub-decoder 210. When at least one of the first input signal A, the second input signal B, and the third input signal C is high, at least one of the fourth transistor M4, the fifth transistor M5, and the sixth transistor M6 is turned off. Thus, the logic circuit of the second sub-decoder 210-1 does not sink the scan line Sn.

As a result, when at least one of the first input signal A, the second input signal B, and the third input signal C is high, the voltage of the first node N1 connected to the scan line scan[n] is maintained as the high level voltage of the first power source voltage VDD and the scan signal scan[n] transmitted through the scan line Sn has the high pulse. The switching transistor T2 of the pixel 40 receiving the scan signal scan[n] of the high pulse is turned off such that the organic light emitting diode (OLED) of the pixel 40 does not emit the light.

When the first input signal A, the second input signal B, and the third input signal C are all low, the first input-bar signal /A, the second input-bar signal /B, and the third input-bar signal /C are all high. Accordingly, the first transistor M1, the second transistor M2, and the third transistor M3 are turned off. Thus, the first power source voltage VDD is not transmitted to the first node N1.

Simultaneously, the gate electrodes of the fourth transistor M4, the fifth transistor M5, and the sixth transistor M6 receive the first input signal A, the second input signal B, and the third input signal C that are all low. Thus, the fourth transistor M4, the fifth transistor M5, and the sixth transistor M6 are all turned on, and the second power source voltage VSS as the low voltage level is applied to the first node N1. That is, the current according to the second power source voltage VSS is sunk from the first node N1.

As a result, when the first input signal A, the second input signal B, and the third input signal C are all low, the voltage of the first node N1 is maintained as the low level voltage and the scan signal scan[n] transmitted through the scan line Sn has the low pulse. The switching transistor T2 of the pixel 40-1 receiving the scan signal of the low pulse is turned on, and the organic light emitting diode (OLED) of the pixel 40-1 emits the light through the driving current according to the corresponding data voltage.

FIG. 4 illustrates the OR gate as having three inputs. However embodiments are not limited thereto, and the number of transistors included in the logic circuit of the second sub-decoder 210-1 or the logic circuit of the second sub-decoder 220-1 may be controlled to control the number of inputs.

According to the OR gate of the scan driver 20 according to the exemplary embodiment of FIG. 4, when the scan signal scan[n] is generated as the high pulse, at least one among three PMOS transistors of the logic circuit of the second sub-decoder 220-1 is turned on, such that the source current corresponding to the first power source voltage VDD is supplied to the first node N1, while, when the scan signal scan[n] is generated as the low pulse, three PMOS transistors of the logic circuit of the second sub-decoder 210-1 are turned on, such that the sink current flows in the first node N1.

Accordingly, the scan driver 20 according to an exemplary embodiment includes two second sub-decoders, thereby having the controlling structure to flow the source current or the sink current according to the input signal. That is, the scan signal may be generated and transmitted to the corresponding scan line through the push-pull structure in which the source current or the sink current flows to the node connected to the corresponding scan line of the plurality of scan lines and the corresponding pixel such that the voltage of the node is increased or decreased, allowing high speed operation.

Also, the logic circuit of the second sub-decoders 210-1 and 220-1 is a one step amplification circuit, such that the propagation delay time is small, thereby obtaining the improved scan speed.

The pixel 40-2 according to the exemplary embodiment of FIG. 5 including NMOS transistors is turned on and operated when the voltage level transmitted to the gate electrode of the switching transistor TR2 and the driving transistor TR1 is high. When the scan signal scan[n] transmitted to the gate electrode of the switching transistor TR2 of the pixel 40-2 transmits the pulse of the high voltage level, the switching transistor TR2 is turned on such that the pixel 40-2 is operated.

Accordingly, the transistors in the logic circuit of the second sub-decoder 220-2 are all turned on and the transistors in the logic circuit of the second sub-decoder 210-2 are all turned off, such that the scan signal scan[n] is applied as the pulse of the high level. In the rest condition, all scan signals scan[n] are applied as the pulse of the low level such that the second logic gate realized by the logic circuit of the second sub-decoder 210-2 and the logic circuit of the second sub-decoder 220-2 in FIG. 5 is an AND gate. Transistors forming the logic circuit of the second sub-decoder 210-2 and the logic circuit of the second sub-decoder 220-2 are NMOS transistors.

The logic circuit of the second sub-decoder 220-2 includes a first transistor M11, a second transistor M12, and a third transistor M13 coupled in series between the first power source voltage VDD and a second node N2 of the scan line Sn connected to the n-th pixel row. The first transistor M11, the second transistor M12, and the third transistor M13 each have gate electrodes receiving an input signal.

The first transistor M11, the second transistor M12, and the third transistor M13 are sequentially coupled in series. A source electrode of the first transistor M11 is connected to the first power source voltage VDD, and a drain electrode of the first transistor M11 is connected to a source electrode of the second transistor M12. A drain electrode of the second transistor M12 is connected to a source electrode of the third transistor M13, and a drain electrode of the third transistor M13 is connected to the second node N2.

Three input signals input to the gate electrodes of the first transistor M11, the second transistor M12, and the third transistor M13 are a fourth input signal X, a fifth input signal Y, and a sixth input signal Z output from the first sub-decoders 110, 120, and 130 forming the first decoder 100 of the scan driver of FIG. 2.

The logic circuit of the second sub-decoder 210-2 includes a fourth transistor M14, a fifth transistor M15, and a sixth transistor M16 coupled in parallel between the second node N2 and the second power source voltage VSS. The fourth transistor M14, the fifth transistor M15, and the sixth transistor M16 each include a gate electrode receiving an input signal, a source electrode connected to the second node N2, and a drain electrode connected to the second power source voltage VSS.

Three input signals input to the gate electrodes of the fourth transistor M14, the fifth transistor M15, and the sixth transistor M16 are the inverted signals of the input signals of the logic circuit of the second sub-decoder 220-2, i.e., the fourth input-bar signal /X, the fifth input-bar signal /Y, and the sixth input-bar signal /Z.

The operation process of the logic circuit of the second sub-decoders 210 and 220 will be described with reference to a truth table of the AND gate provided below as Table 2.

TABLE 2

| Fourth input signal X | Fifth input signal Y | Sixth input signal Z | Scan[n] |
|---|---|---|---|
| 0 | 0 | 0 | 0 |
| 0 | 0 | 1 | 0 |
| 0 | 1 | 0 | 0 |
| 0 | 1 | 1 | 0 |
| 1 | 0 | 0 | 0 |
| 1 | 0 | 1 | 0 |
| 1 | 1 | 0 | 0 |
| 1 | 1 | 1 | 1 |

When at least one of the fourth input signal X, the fifth input signal Y, and the sixth input signal Z is low, at least one of the first transistor M11, the second transistor M12, and the third transistor M13 is turned off, such that the logic circuit of the second sub-decoder 220-2 does not source current to the scan line Sn.

Simultaneously, the gate electrodes of the fourth transistor M14, the fifth transistor M15, and the sixth transistor M16 included in the logic circuit of the second sub-decoder 210-2 receive the fourth input-bar signal /X, the fifth input-bar signal /Y, and the sixth input-bar signal /Z. When at least one of the fourth input signal X, the fifth input signal Y, and the sixth input signal Z is low, at least one of the inverted fourth input-bar signal /X, the inverted fifth input-bar signal /Y, and the inverted sixth input-bar signal /Z is high. Accordingly, at least one of the fourth transistor M14, the fifth transistor M15, and the sixth transistor M16 is turned on.

Thus, the second power source voltage VSS is transmitted to the second node N2 as the low level voltage through the turned on transistor of the fourth transistor M14, the fifth transistor M15, and the sixth transistor M16. That is, the current according to the second power source voltage VSS sinks from the second node N2.

As a result, if one of the fourth input signal X, the fifth input signal Y, and the sixth input signal Z is low, the voltage of the second node N2 is maintained as the low level voltage of the second power source voltage VSS and the scan signal scan[n] has the low pulse. The switching transistor TR2 of the pixel 40-2 receiving the scan signal of the low pulse is turned off such that the organic light emitting diode (OLED) does not emit the light.

When the fourth input signal X, the fifth input signal Y, and the sixth input signal Z are all high, the first transistor M11, the second transistor M12, and the third transistor M13 of the NMOS transistor are all turned on. Thus, the first power source voltage VDD is applied to the second node N2 through the first transistor M11, the second transistor M12, and the third transistor M13. That is, the current according to the first power source voltage VDD is supplied to the second node N2.

Simultaneously, the gate electrodes of the fourth transistor M14, the fifth transistor M15, and the sixth transistor M16 receive the fourth input-bar signal /X, the fifth input-bar signal /Y, and the sixth input-bar signal /Z (which the fourth input signal X, the fifth input signal Y, and the sixth input signal Z are inverted), such that the fourth input-bar signal /X, the fifth input-bar signal /Y, and the sixth input-bar signal /Z are all low. Accordingly, the fourth transistor M14, the fifth transistor M15, and the sixth transistor M16 are turned off, such that the second power source voltage VSS is not transmitted to the second node N2.

As a result, if the fourth input signal X, the fifth input signal Y, and the sixth input signal Z are all high, the first power source voltage VDD is transmitted such that the voltage of the second node N2 is maintained as the high level voltage and the scan signal scan[n] has the high pulse. The switching transistor TR2 of the pixel 40 transmitted with the scan signal of the high pulse is turned on and the organic light emitting diode (OLED) included in the pixel emits the light through the driving current according to the corresponding data signal data[m].

FIG. 5 shows the AND gate including the logic circuit of the second sub-decoder 210-2 and 220-2 having three inputs. However, embodiments are not limited thereto, and the number of transistors included in the logic circuit of the second sub-decoders 210-2 and 220-2 may be variously set.

According to the AND gate circuit of the scan driver 20 according to the exemplary embodiment of FIG. 5, when the scan signal scan[n] transmitted to the corresponding scan line Sn is the low pulse, at least one of three NMOS transistors of the logic circuit of the second sub-decoder 210-2 is turned on, such that the sink current flows in the second node N2, while, when the scan signal is generated as the high pulse, three NMOS transistors of the logic circuit of the second sub-decoder 220-2 are all turned on, such that the source current flows in the second node N2.

Accordingly, the scan driver 20 according to an exemplary embodiment includes the second decoder consisting of two second sub-decoders to flow the sink current or the source current according to the input signal such that the voltage of the second node N2 is increased or decreased, and thereby the scan signal may be generated with the high speed.

While this invention has been described in connection with what is presently considered to be exemplary embodiments, it is to be understood that the invention is not limited to the disclosed embodiments. A person having ordinary skill in the art can change or modify the described embodiments without departing from the scope of the present invention, and it will be understood that the present invention should be construed to cover the modifications or variations. Further, the material of each of the constituent elements described in the specification can be readily selected from among various known materials and replaced thereby by a person having ordinary skill in the art. Further, a person having ordinary skill in the art can omit some of the constituent elements described in the specification without deteriorating performance or can add constituent elements in order to improve performance. In addition, a person having ordinary skill in the art may change the sequence of the steps described in the specification according to process environments or equipment. Accordingly, the scope of the present invention should be determined not by the above-described exemplary embodiments, but by the appended claims and their equivalents.

| <Description of symbols> | |
|---|---|
| 10: display unit | 20: scan driver |
| 30: data driver | 40, 40-1, 40-2: pixel |
| 50: controller | |
| 100: first decoder | 200: second decoder |
| 110, 120, 130: first sub-decoder | |
| 210, 210-1, 210-2, 220, 220-1, 220-2: second sub-decoder | |

What is claimed is:

1. A scan driver, comprising:

a first decoder generating a plurality of output signals through a plurality of first logic gates; and a second decoder including:

a plurality of first logic circuits, each of the first logic circuits connected to corresponding ones of first terminals of a plurality of scan lines, and a plurality of second logic circuits, each of the second logic circuits connected to corresponding ones of second terminals of the plurality of scan lines, wherein:

for each of the plurality of scan lines, the first terminals are at first ends of respective scan lines and the second terminals are at second ends of the respective scan lines, a pixel is coupled between the first and second terminals, each of the plurality of first logic circuits supply a source current to a corresponding scan line according to a plurality of corresponding first output signals among the plurality of output signals, each of the plurality of second logic circuits sink a sink current to a corresponding scan line according to a plurality of corresponding second output signals among the plurality of output signals, and each of the first logic circuits include a plurality of first transistors switched in response to respective ones of the plurality of corresponding first output signals, all of first terminals of the plurality of the first transistors directly connected together and to a first high power source voltage, and all of second terminals of the plurality of the first transistors directly connected together and to said first terminal of the corresponding scan line.

2. The scan driver as claimed in claim 1, wherein the first decoder includes a plurality of first sub-decoders, each first sub-decoder including a subset of the plurality of first logic gates that generate a subset of the plurality of output signals.

3. The scan driver as claimed in claim 1, wherein the second decoder includes a first sub-decoder including the plurality of first logic circuits and a second sub-decoder including the plurality of second logic circuits.

4. The scan driver as claimed in claim 1, wherein:

each of the first logic circuits supplies the source current corresponding to the first high power source voltage to the corresponding scan line according to switching states of the plurality of first transistors; and each of the second logic circuits respectively includes a plurality of second transistors switched in response to respective ones of the plurality of corresponding second output signals, and sinks the sink current corresponding to a second power source voltage to the corresponding scan line according to switching states of the plurality of second transistors.

5. The scan driver as claimed in claim 4, wherein:

a pulse voltage of a scan signal transmitted to a corresponding one of the scan lines is has a first level from a corresponding one of the first logic circuits, and a pulse voltage of the scan signal transmitted to the corresponding scan line has a second level from a corresponding one of the second logic circuits.

6. The scan driver as claimed in claim 4, wherein the plurality of first and second transistors are either NMOS transistors or PMOS transistors.

7. The scan driver as claimed in claim 6, wherein the plurality of first and second transistors all transistors of a corresponding pixel circuit are either NMOS transistors or PMOS transistors.

8. The scan driver as claimed in claim 7, wherein:

the plurality of first and second transistors are PMOS transistors;

the plurality of first transistors are coupled in parallel between the first power source voltage and the corresponding scan line, and gate electrodes of the plurality of first transistors receive a plurality of first input signals, respectively, and the plurality of second transistors are coupled in series between the corresponding scan line and the second power source voltage, and gate electrodes of the plurality of second transistors receive a plurality of second input signals, respectively.

9. The scan driver as claimed in claim 8, wherein:

the plurality of first input signals are the first output signals, and the plurality of second input signals are the second output signals.

10. The scan driver as claimed in claim 8, wherein a second logic gate realized by the first logic circuit and the second logic circuit is an OR gate.

11. The scan driver as claimed in claim 1, wherein a number of first logic gates of the first decoder is determined according to a number of the scan lines.

12. The scan driver as claimed in claim 1, wherein a combination of the first logic circuit and the second logic circuit forms an OR gate, and a pixel circuit element connected to a corresponding one of the plurality of scan lines includes a PMOS transistor.

13. The scan driver as claimed in claim 1, wherein the first output signals for the plurality of first logic circuits are inverse to the second output signals for the plurality of second logic circuits.

14. A display device, comprising:

a scan driver transmitting a plurality of scan signals to a plurality of scan lines;

a data driver transmitting a plurality of data signals to the plurality of data lines; and a plurality of pixels respectively connected to the corresponding scan line among the plurality of scan lines and the corresponding data line among the plurality of data lines, and including an organic light emitting diode (OLED) emitting light through a driving current according to the data signal by being selected when the scan signal is transmitted, and receiving the data signal, wherein the scan driver includes a first decoder generating a plurality of output signals through a plurality of first logic gates, and a second decoder including:

a plurality of first logic circuits, each of the first logic circuits connected to corresponding ones of first terminals of a plurality of scan lines, and a plurality of second logic circuits, each of the second logic circuits connected to corresponding ones of second terminals of the plurality of scan lines, wherein:

for each of the plurality of scan lines, the first terminals are at first ends of respective scan lines and the second terminals are at second ends of the respective scan lines, one of the pixels is coupled between the first and second terminals, each of the plurality of first logic circuits supply a source current to a corresponding scan line according to a plurality of corresponding first output signals among the plurality of output signals, each of the plurality of second logic circuits sink a sink current to a corresponding scan line according to a plurality of corresponding second output signals among the plurality of output signals, and each of the first logic circuits include a plurality of first transistors switched in response to respective ones of the plurality of corresponding first output signals, all of first terminals of the plurality of the first transistors directly connected together and to a first high power source voltage, and all of second terminals of the plurality of the first transistors directly connected together and to said first terminal of the corresponding scan line.

15. The display device as claimed in claim 14, wherein the second decoder includes a first sub-decoder including the plurality of first logic circuits and a second sub-decoder including the plurality of second logic circuits.

16. The display device as claimed in claim 14, wherein:

each first logic circuit supplies the source current corresponding to the high first power source voltage to the corresponding scan line according to switching states of the plurality of first transistors; and each second logic circuit respectively includes a plurality of second transistors switched in response to respective ones of the plurality of corresponding second output signals, and sinks the sink current corresponding to a second power source voltage to the corresponding scan line according to switching states of the plurality of second transistors.

17. The display device as claimed in claim 16, wherein:

a pulse voltage of a scan signal transmitted to a corresponding one of the scan lines is has a first level from a corresponding one of the first logic circuits, and a pulse voltage of the scan signal transmitted to the corresponding scan line has a second level from a corresponding one of the second logic circuits.

18. The display device as claimed in claim 16, wherein the plurality of first and second transistors are either NMOS transistors or PMOS transistors.

19. The display device as claimed in claim 18, wherein the plurality of first and second transistors and all transistors of a corresponding pixel circuit are either NMOS transistors or PMOS transistors.

20. The display device as claimed in claim 19, wherein:

the plurality of first and second transistors are PMOS transistors;

the plurality of first transistors are coupled in parallel between the first power source voltage and the corresponding scan line, and gate electrodes of the plurality of first transistors receive a plurality of first input signals, respectively, and the plurality of second transistors are coupled in series between the corresponding scan line and the second power source voltage, and gate electrodes of the plurality of second transistors receive a plurality of second input signals, respectively.

21. The display device as claimed in claim 14, wherein a combination of the first logic circuits and the second logic circuits form an OR gate, and a pixel circuit element connected to a corresponding one of the plurality of scan lines includes a PMOS transistor.

22. The display device as claimed in claim 14, wherein the first output signals for the plurality of first logic circuits are inverse to the second output signals for the plurality of second logic circuits.

* * * * *